US006244697B1

(12) United States Patent
Powers et al.

(10) Patent No.: US 6,244,697 B1
(45) Date of Patent: Jun. 12, 2001

(54) FILTER TOWER FOR INK JET PRINTHEAD

(75) Inventors: James Harold Powers, Lexington; Matthew Joe Russell, Stamping Ground, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/343,918

(22) Filed: Jun. 30, 1999

(51) Int. Cl.[7] ..... B41J 2/175
(52) U.S. Cl. ..... 347/93
(58) Field of Search ..... 347/93, 86, 92, 347/85, 87

(56) References Cited

U.S. PATENT DOCUMENTS

| | | | | |
|---|---|---|---|---|
| 4,015,272 | | 3/1977 | Yamamori et al. . | |
| 4,484,202 | * | 11/1984 | Sayko | 347/85 |
| 4,536,777 | | 8/1985 | Matsumoto . | |
| 5,113,205 | | 5/1992 | Sato et al. . | |
| 5,489,932 | | 2/1996 | Ceschin et al. . | |
| 5,537,136 | | 7/1996 | Brandon et al. . | |
| 5,552,816 | | 9/1996 | Oda et al. . | |
| 5,631,682 | | 5/1997 | Takata . | |
| 5,742,314 | * | 4/1998 | Hayes | 347/93 |
| 5,774,154 | * | 6/1998 | Underwood | 347/87 |
| 5,905,518 | | 5/1999 | DeFilippis . | |

FOREIGN PATENT DOCUMENTS

| | | |
|---|---|---|
| 94 05 723 | 6/1994 | (DE) . |
| 2-194969 | 8/1990 | (JP) . |

* cited by examiner

*Primary Examiner*—John Barlow
*Assistant Examiner*—Charles W. Stewart, Jr.
(74) *Attorney, Agent, or Firm*—Michael T. Sanderson; Luedeka, Neely & Graham

(57) ABSTRACT

A filter tower structure for removing air or gas bubbles from an ink jet printing structure which includes a filter tower attached to an ink reservoir for feeding ink from the reservoir to a printhead, the filter tower structure including a conduit having an interior in flow communication with the ink reservoir and the printhead and a tube having a first end in flow communication with the interior of the conduit and a second end in flow communication with a vacuum source, wherein activation of the vacuum source results in the application of a reduced pressure to the interior of the conduit such that air or gas bubbles are caused to flow into the tube and exit the conduit and ink from the reservoir is caused to flow into the conduit.

17 Claims, 3 Drawing Sheets

FILTER TOWER FOR INK JET PRINTHEAD

FIELD OF THE INVENTION

The invention relates to ink jet printers and in particular to a filter tower structure for removing air from permanent and semi-permanent printhead assemblies.

BACKGROUND OF THE INVENTION

During the lifespan of an ink jet printhead assemblies or "pens", air or gas bubbles develop in the ink and coalesce into larger bubbles. As the bubbles form and coalesce, they tend to accumulate in the ink feed port, filter areas and ink feed channels of the pen. If the amount of air or gas bubbles increases significantly, performance of the pen may be affected. For disposable pens, air accumulation is not typically a significant problem. However, for longer life permanent or semi-permanent pens, and for high quality, high speed pens, substantial air or gas bubble accumulation may adversely affect printhead performance by causing misfiring or ink flow blockages.

A primary source causing air or gas bubbles in the ink feed port, between the printhead and ink cartridge, arises from the removal and connection of ink cartridges with the pen. If a spent ink cartridge is allowed to run dry of ink, air will fill the ink feed port connecting the cartridge to the carrier/printhead assembly. Even if the ink cartridge is not run dry of ink, a certain amount of air is introduced into the ink feed port each time the ink cartridge is connected and/or disconnected from the carrier/printhead assembly. Some of the air or gas bubbles which make their way into the ink flow channels of the pen are removed from the printhead through ejection orifices, however, a portion of the air or gas bubbles under the action of buoyancy may migrate back through the ink feed paths into the ink feed port in the connection between the pen and the ink cartridge.

Priming the pen by ejection of ink may remove air or gas bubbles from the printhead itself, however, there may still be a substantial amount of air in the ink feed port due to cartridge replacement. This air is effectively trapped between the pen and the ink cartridge in the connection port connecting the cartridge to the pen assembly.

An object of the invention is to provide an apparatus and method for removing air and gas bubbles from an ink jet pen.

Another object of the invention is to provide a device for removing a substantial quantity of air from an ink feed port.

Still another object of the invention is to improve the operation of a permanent or semi-permanent pen.

SUMMARY OF THE INVENTION

With regard to the foregoing and other objects and advantages, the invention provides a filter tower structure for an ink jet printer pen, the filter tower structure including an elongate conduit having a first open end and a second end, the second end being closed by a filtering media and the conduit having an upper end thereof adjacent the filtering media in selective flow communication with a vacuum source.

In another aspect, the filter tower structure includes a filter tower attached to an ink reservoir for feeding ink from the reservoir to an ink jet pen. The filter tower includes a conduit having an interior in flow communication with the ink reservoir and the pen and a tube having a first end in flow communication with the interior of the conduit and a second end in flow communication with a vacuum source. Activation of the vacuum source results in the application of a reduced pressure to the interior of the conduit such that air or gas bubbles are caused to flow into the tube from the conduit and ink from the reservoir is caused to flow into the conduit.

In another aspect the invention provides an ink jet printing device including a carrier structure containing one or more permanent or semi-permanent printheads, a filtration and air removal system connected to the carrier structure in ink flow communication with the printheads, a replaceable ink cartridge containing an ink supply for supply of ink to the printheads. The ink cartridge is removably connected to the filtration and air removal system attached to the ink cartridge. The air removal device includes a conduit having an interior in flow communication with the ink cartridge and the printheads and a tube having a first end in flow communication with the interior of the conduit and a second end in flow communication with a vacuum source.

Activation of the vacuum source results in the application of a reduced pressure to the interior of the conduit such that air or gas bubbles are caused to flow into the tube from the conduit and ink from the ink cartridge is caused to flow into the conduit.

An advantage of the air or gas bubble removal system of the invention is that it is configured so that air or gas bubbles may be easily removed after a new ink reservoir has been installed on the printhead so as to avoid problems common to printing devices having replaceable cartridges. The present invention, as described below, provides a substantial improvement in the ability to remove air or gas bubbles from the ink feed port.

BRIEF DESCRIPTION OF THE DRAWINGS

Further advantages of the invention will become apparent by reference to the detailed description when considered in conjunction with the figures, which are not no scale, wherein like reference characters indicate like elements through the several views and wherein.

DETAILED DESCRIPTION OF THE INVENTION

Figure 1:
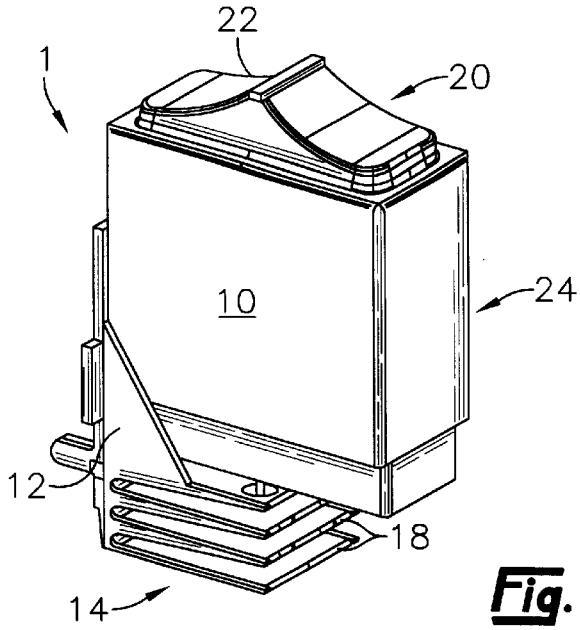
FIG. 1 is a perspective view of a removable ink supply cartridge assembled to printhead carrier for use in an ink jet printer.
Figure 2:
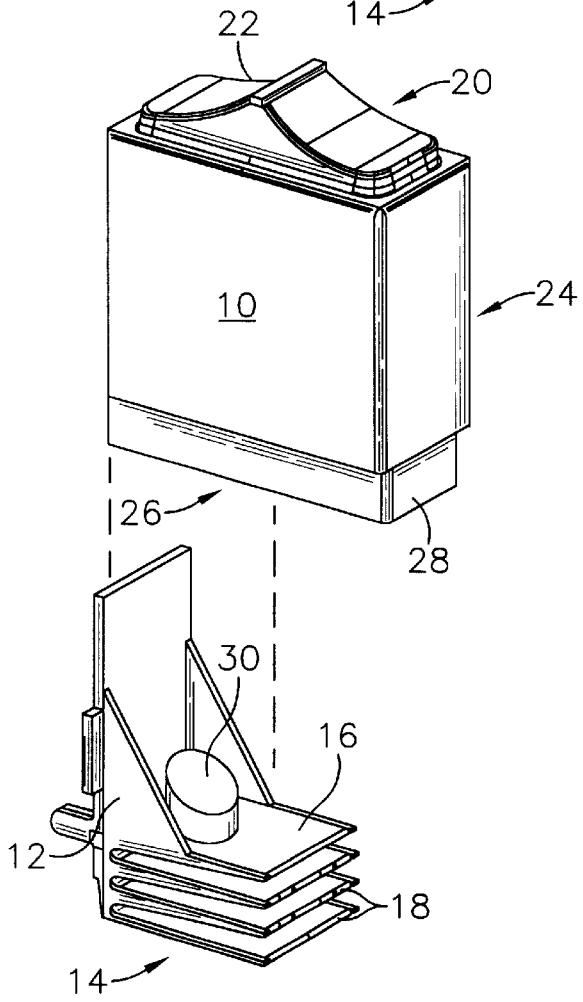
FIG. 2 is an exploded view in perspective of the cartridge and carrier of FIG. 1.
Figure 3:
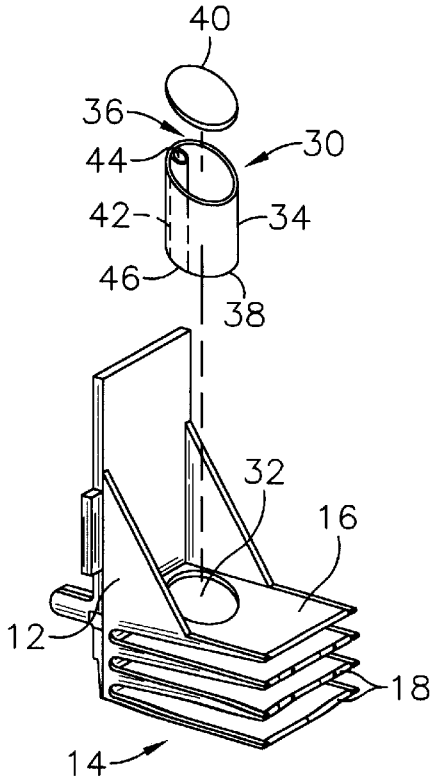
FIG. 3 is an exploded view in perspective showing a carrier and filter tower structure.
Figure 4:
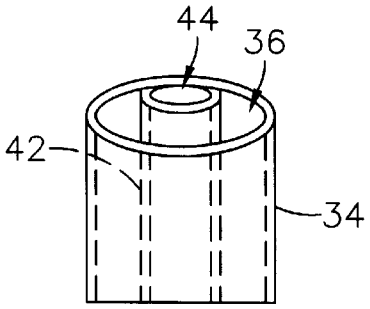
FIG. 4 is a front perspective view of a filter tower structure in accordance with a preferred embodiment of the invention.
Figure 5:
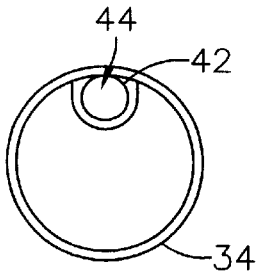
FIG. 5 is a top plan view of the filter tower structure of FIG. 4.

With reference to FIGS. 1–3, there is shown, in perspective view, a pen 1 for use with an ink jet printer and having a replaceable ink supply cartridge 10 connected to a permanent or semi-permanent printhead carrier 12. The ink cartridge 10 may contain a single color ink, such as black, cyan, magenta or yellow or may contain multiple colors of ink. The carrier 12 may be configured to attach to a single cartridge 10 or may be expanded to hold multiple cartridges 10. In the case of a single color ink cartridge 10, the carrier 12 typically contains a single printhead 14 on a side of the carrier 12 opposite the cartridge connection side 16 thereof. In the case of multiple cartridges 10 or multicolor cartridges 10, the carrier 12 may contain multiple printheads 14, typically three or four printheads 14.

In high speed, high quality printing operations, it is preferred that the carrier 12 be adapted to remove heat from the printhead attached thereto. This may be accomplished by constructing the carrier 12 out of a heat conducting metal such as aluminum or zinc and/or by providing heat conducting fms 18 on the carrier 12 to conduct heat away from the printhead by conduction and convention.

The cartridge 10 has an upper portion 20 containing a handle 22 and a lower portion 24. An outlet port 26 is located on bottom 28 of the lower portion 24 and is initially sealed as by a ruptureable membrane or a septum with a pre-pierced aperture. The membrane is ruptured by the filter tower 30 during installation of the cartridge 10 onto the carrier 12 when the cartridge 10 is fully seated on the carrier 12. In its attached configuration, the filter tower 30 of the pen is in flow communication with ink within the cartridge 10 and the printhead 14 for providing an ink feed path for conducting ink from a reservoir within the cartridge 10 and for filtration of ink conducted from the cartridge 10 to the printhead 14.

The filter tower 30 is fixedly or removably attached to the carrier 12 by inserting lower open end 38 into a port or opening 32 extending through the side 16 of the carrier 12 above and adjacent the printhead 14, the opening 32 being in flow communication with the printhead. A seal such as O-rings, adhesives, elastomeric collars or the like is preferably provided to seal against leakage of ink through the junction of the tower 30 and the opening 32. Likewise, a similar seal is also preferably provided to seal against leakage through the junction of the tower 30 and the port 26 of the cartridge 10.

Turning to FIGS. 3–6, the tower 30 includes a conduit 34 preferably of substantially circular cross-section and having an a first open end 36 in flow communication with the port 26 of the attached cartridge and a lower open end 38 in flow communication with the printhead 14. The conduit 34 is preferably continuous between its open ends and is preferably made of a material similar to that of the cartridge, such as a polymeric or plastic composition that is resistant and impermeable to ink.

Figure 6:
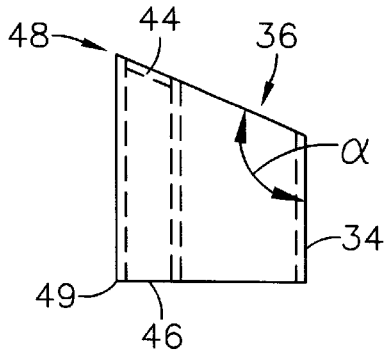
FIG. 6 a side view of the filter tower structure of FIG. 5.

The end 36 has a peripheral edge which may be perpendicular to the axis through the tower or is angled as best seen in FIG. 6, preferably at an angle a of from about 4 to about 70 degrees with respect to a longitudinal axis through the conduit 34 from the open end 36 to a second end 38. A filter 40 made of a conventional filter media material is positioned adjacent the first end 36 for removing debris and impurities from ink traveling from the cartridge to the printhead through the conduit 34. The conduit 34 preferably contains a tube 42 which is positioned along a sidewall of the conduit 34, with its longitudinal axis parallel with the longitudinal axis of the conduit 34. The conduit 34 preferably has a length of from about 4 mm to about 25 mm and a diameter of from about 3 mm to about 30 mm, it being understood that the conduit may be otherwise sized depending upon the dimensions of the cartridge, carrier and printhead and may have a variety of shapes including rectangular, oval, triangular and the like.

The tube 42 is preferably continuous between an upper open end 44 and a lower open end 46 and is preferably co-formed with the conduit 34. The upper open end 44 is preferably located adjacent an uppermost portion 48 of the angled conduit 34 (FIG. 6) and the lower open end 46 is preferably located adjacent a lowermost end 49 of the conduit 34. The tube 42 preferably has a length of from about 0.5 mm to about 100 mm and a diameter of from about 0.5 mm to about 4 mm when used with a conduit of the dimensions described above. The lower open end 46 is preferably in selective flow communication with a vacuum source, as at 50 (FIG. 7), preferably a low-pressure vacuum source operable at a range of pressure of from about 20 cm wc (water column) to about 500 cm wc, for evacuating air and other fluids (liquids and gasses) from the conduit 34.

Figure 7:
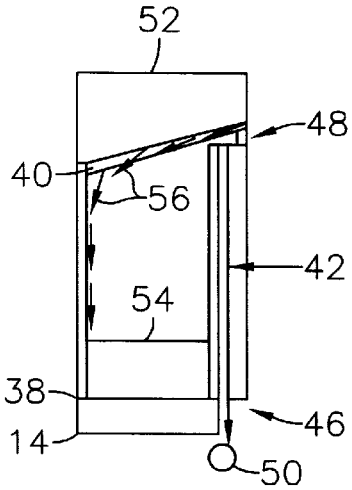
FIGS. 7–9 are cross-sectional side views showing a preferred method for priming a replaced ink cartridge in accordance with the invention.
Figure 8:
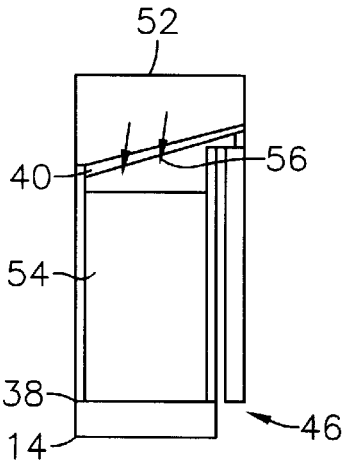
Figure 9:
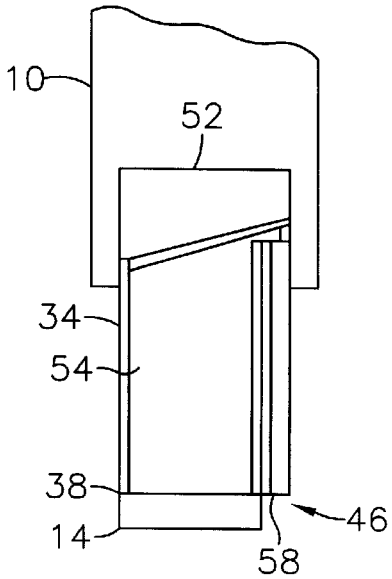

With reference now to FIGS. 7–9, there is shown a preferred method of installing and priming a replacement ink cartridge 10 after the used or empty cartridge 10 has been removed from the carrier. As shown in FIG. 7, the new cartridge having an ink reservoir containing an ink saturated foam 52 is installed on the filter tower and cartridge as by inserting the conduit 34 into the port 26 and rupturing a seal in the port 26. A liquid tight connection is then made between the lower open end 46 of tube 42 and the low-pressure vacuum source 50. This liquid tight connection may be accomplished by providing the tube 42 of sufficient length to extend to a convenient location on the carrier 12 so that end 46 is adjacent a pre-pierced septum and/or a check-ball valve (represented by reference numeral 58 in FIG. 9) in order to close end 46 of tube 42. As will be noted (FIG. 7), the conduit 34 may contain a significant amount of air and a low volume of ink 54 prior to removal of air from conduit 34.

In order to remove air from conduit 34 and to prime the pen, the vacuum source 50 is activated and a predetermined volume of air, such as from about 0.2 mL to about 8 mL, possibly mixed with ink, is removed from the conduit 34 via the tube 42 by applying a reduced or sub-atmospheric pressure to the end 46. As air is removed from the conduit 34 the air is replaced with the same volume of ink from the newly installed cartridge 10, which flows through the filter 40 into the conduit 34 as indicated by the arrows 56. A reduced pressure is applied to continue to draw air from the conduit 34 and promote migration of ink into the conduit (FIG. 8) until the conduit 34 is primed and sufficiently void of air so as to function as desired (FIG. 9). The application of reduced pressure is then ceased and the tube 42 sealed as by plug or valve 58 operable with the source of vacuum. Verification of a sufficiently primed pen may be accomplished as by print tests and the like. If a print test fails to indicate a desirably operable pen, then the valve 58 may be opened and additional vacuum applied to reprime the pen. This repriming step may be repeated until the pen is desirably primed.

As will be appreciated, the invention advantageously enables the removal of air from the ink feed path after a new ink reservoir is installed so that the pen does not suffer disadvantageous effects common to pens of the type having replaceable ink reservoirs.

Figure 10:
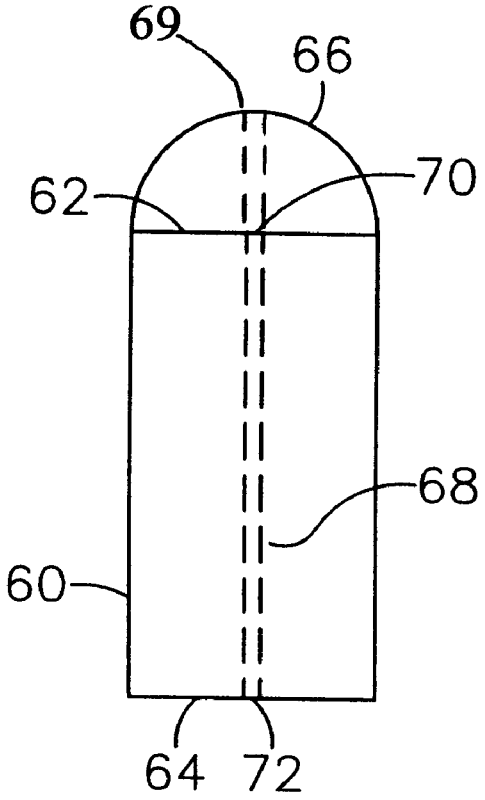
FIG. 10 is a side view of another embodiment of a filter tower structure in accordance with the invention wherein the conduit has a top perpendicular to the cylindrical sides and the filter is a convex, dome shaped filtering media.

Turning now to FIG. 10, there is shown another embodiment of a filter tower structure having a conduit 60 with a first open end 62 opposite second open end 64 which may be positioned in flow communication with a printhead. The periphery of the first open end 62 of this embodiment is substantially perpendicular to an axis through conduit 60 from first end 62 to second end 64. A convex, dome shaped filtering media 66 is attached to end 62. A flow tube 68 is centrally located within the conduit 60 so that it is in flow communication with the uppermost portion 69 of domed filter media 66. The tube 68 includes an upper open end 70 in flow communication with the upper most portion 69 of the filter 66 and a lower open end 72 which may be rendered in selective flow communication with a vacuum source in the manner previously described for the flow tube 42.

Figure 11:
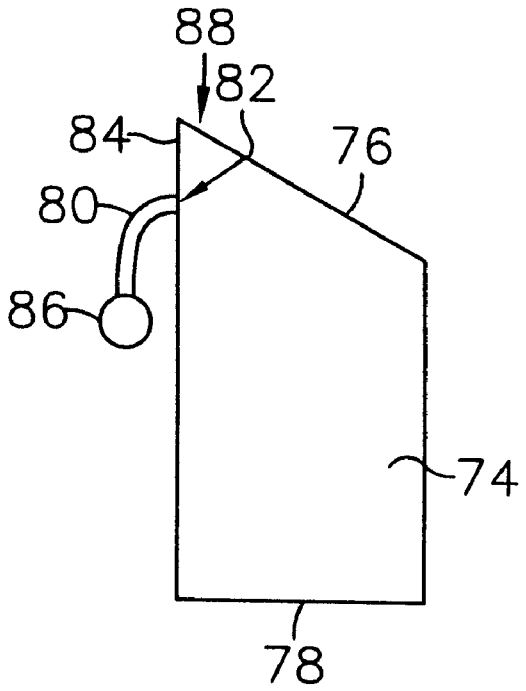
FIG. 11 is a side view of another embodiment of a filter tower structure in accordance with the invention wherein the tube through which vacuum is applied to the tower structure is external to the ink flow path.

FIG. 11 shows another filter tower structure in accordance with the invention which includes a conduit 74 having an angled first open end 76 adjacent which a filtering medium may be attached and a second open end 78 for positioning in flow communication with a printhead. A flow tube 80 having an open end 82 extends through an aperture 84 of the conduit 74. The opposite end of the flow tube is in selective flow communication with a vacuum source 86 for applying vacuum to the conduit 74. The aperture 84 is preferably positioned adjacent an uppermost portion 88 of the angled conduit 74.

The foregoing description of certain embodiments of the invention has been provided for the purposes of illustration only, and it is understood that various modifications or alterations may be made without departing from the spirit and scope of the invention as set forth in the following claims.

What is claimed is:

1. A filter tower structure for an ink jet printer which comprises a filter tower attached to a printhead carrier between the carrier and an ink reservoir for feeding filtered ink from the reservoir to an ink jet pen, the filter tower comprising a conduit having a first open end, a conduit second end, and an interior in flow communication with the ink reservoir and the pen, the conduit second end being closed by a filter media material, and a tube, having a first end located substantially adjacent to the filter media material, in flow communication with the interior of the conduit and having a first end, the first end of the tube being located substantially adjacent to the filter media material and a tube second end in flow communication with a vacuum source, wherein activation of the vacuum source results in the application of a reduced pressure to the interior of the conduit such that air or gas bubbles are caused to flow into the tube from the conduit and ink from the reservoir is caused to flow into the conduit.

2. The filter tower structure of claim 1 wherein, the conduit has an interior sidewall and the tube is adjacent the interior sidewall.

3. The filter tower structure of claim 1 wherein the conduit has an angled upper end and the first end of the tube is adjacent the angled upper end.

4. A pen and ink cartridge containing ink for an ink jet printer, the pen containing a printhead and a filtration device for filtering ink and for removing air or gas bubbles from an ink feed port for the printhead the filtration device comprising a conduit having a first open end, a conduit second end, and an interior in flow communication with an ink reservoir and the printhead, the conduit second end being closed by a filter media material, and a tube having a first end located substantially adjacent to the filter media material in flow communication with the interior of the conduit and a tube having a first end, the first end of the tube being located substantially adjacent to the filter media material and second end in flow communication with a vacuum source, wherein activation of the vacuum source results in the application of a reduced pressure to the interior of the conduit such that air or gas bubbles are caused to flow into the tube and exit the conduit and ink from the reservoir is caused to flow into the conduit.

5. The pen of claim 4 wherein, the conduit has an interior sidewall and the tube is adjacent the interior sidewall.

6. The pen of claim 4 wherein the conduit has an angled upper end and the first end of the tube is adjacent the angled upper end.

7. An ink jet printing device comprising a carrier structure containing one or more permanent or semi-permanent printheads, a filtration and air removal system connected to the carrier structure in ink flow communication with the printheads, a replaceable ink cartridge containing an ink supply for supply of ink to the printheads, said ink cartridge being removably connected to said filtration and air removal system, the air removal device containing a conduit having a first open end, a conduit second end, and an interior in flow communication with the ink cartridge and the printheads, the conduit second end being closed by a filter media material, and a tube having a first end located substantially adjacent to the filter media material in flow communication with the interior of the conduit and a tube having a first end, the first end of the tube being located substantially adjacent to the filter media material and second end in flow communication with a vacuum source, wherein activation of the vacuum source results in the application of a reduced pressure to the interior of the conduit such that air or gas bubbles are caused to flow into the tube from the conduit and ink from the ink cartridge is caused to flow into the conduit.

8. The device of claim 7 wherein, the conduit has an interior sidewall and the tube is adjacent the interior sidewall.

9. The device of claim 7 wherein the conduit has an angled upper end and the first end of the tube is adjacent the angled upper end.

10. A filter tower structure for an ink jet printer pen, the filter tower structure comprising an elongate conduit having a first open end and a conduit second end, the conduit second end being closed by a filtering media and the conduit having an upper end thereof adjacent the filtering media in selective flow communication with a vacuum source.

11. The tower structure of claim 10, further comprising a flow tube longitudinally aligned with the conduit and positioned within the conduit, the flow tube having a first end in flow communication with the upper end of the conduit and a tube second end in flow communication with the vacuum source such that operation of the vacuum source results in application of a reduced pressure to the upper end of the conduit for removing fluid from the conduit.

12. The tower structure of claim 10, wherein the filtering media comprises a convex, dome-shaped filter element.

13. A filter tower structure for an ink jet printer which comprises an elongate conduit having a lower open end and a conduit upper end, the conduit upper end being closed by a filtering media and the conduit containing therein a flow tube having a first open end and a tube upper open end, the tube upper open end being in flow communication with the conduit upper end and the first open end of the flow tube being in flow communication with a vacuum source.

14. The filter tower structure of claim 13, wherein the upper end of the conduit has an upper portion and a lower portion.

15. The filter tower structure of claim 14, wherein the upper portion is on an opposite side of the conduit from the lower portion.

16. The filter tower structure of claim 13, wherein the filtering media comprises a convex, dome-shaped filter element.

17. The filter tower structure of claim 13, wherein the flow tube is adjacent a sidewall of the conduit.

* * * * *